United States Patent [19]

Obrist

[11] 4,161,258

[45] Jul. 17, 1979

[54] STOPPER ARRANGEMENT FOR BOTTLES

[76] Inventor: Albert Obrist, Therwilerstr. 12, Reinach BL, Switzerland, 4153

[21] Appl. No.: 890,939

[22] Filed: Mar. 28, 1978

[30] Foreign Application Priority Data

Mar. 29, 1977 [CH] Switzerland ..... 3926/77

[51] Int. Cl.[2] ..... B65D 41/04

[52] U.S. Cl. ..... 215/302; 215/329

[58] Field of Search ..... 215/302, 305, 318, 320, 215/321, 329

[56] References Cited

U.S. PATENT DOCUMENTS

| | | | |
|---|---|---|---|
| 3,223,269 | 12/1965 | Williams | 215/318 |
| 3,872,993 | 3/1975 | Aichinger | 215/320 |
| 4,000,825 | 1/1977 | Westfall | 215/318 |

FOREIGN PATENT DOCUMENTS

| | | | |
|---|---|---|---|
| 1357020 | 2/1964 | France | 215/305 |

*Primary Examiner*—Donald F. Norton

*Attorney, Agent, or Firm*—Larson, Taylor and Hinds

[57] ABSTRACT

In a stopper arrangement for bottles of the type having an externally threaded neck closable by a synthetic plastic screw cap, the screw cap has an approximately cylindrical internally threaded wall part which is closed by an upper lid surface. The screw cap is so dimensioned and configured, and is formed of such an elastic plastic material, that the cap can be removed by unscrewing, or can be removed by a conventional crown cork opener. In either case, the cap can be used to reclose the bottle, since it is specially constructed so as not to be destroyed if removed by a crown cork opener. Important features of the screw cap involve the number of threads, the pitch angle of the threads, the thread depth, the thickness of the cylindrical wall part, the provision of a protruding section engageable by the lifting portion of a crown cork opener, the distance between the lid surface and the protruding section, and the elasticity of the plastic material considered in conjunction with the dimensions and configuration of the cap. The inner side of the lid surface preferably is formed with a sealing member which extends into the bottle opening.

18 Claims, 5 Drawing Figures

Fig. 3
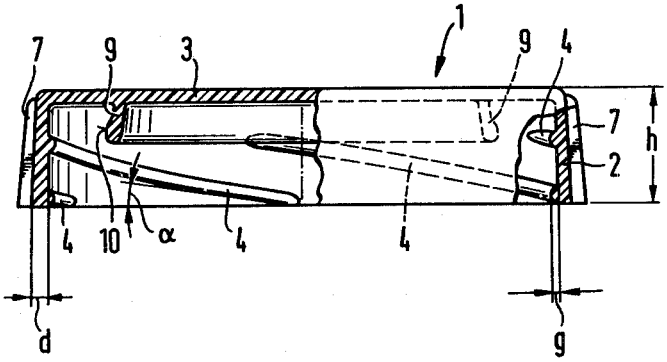
Fig. 5
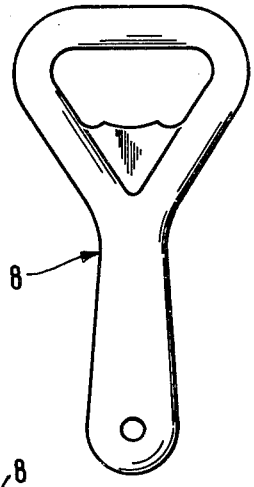
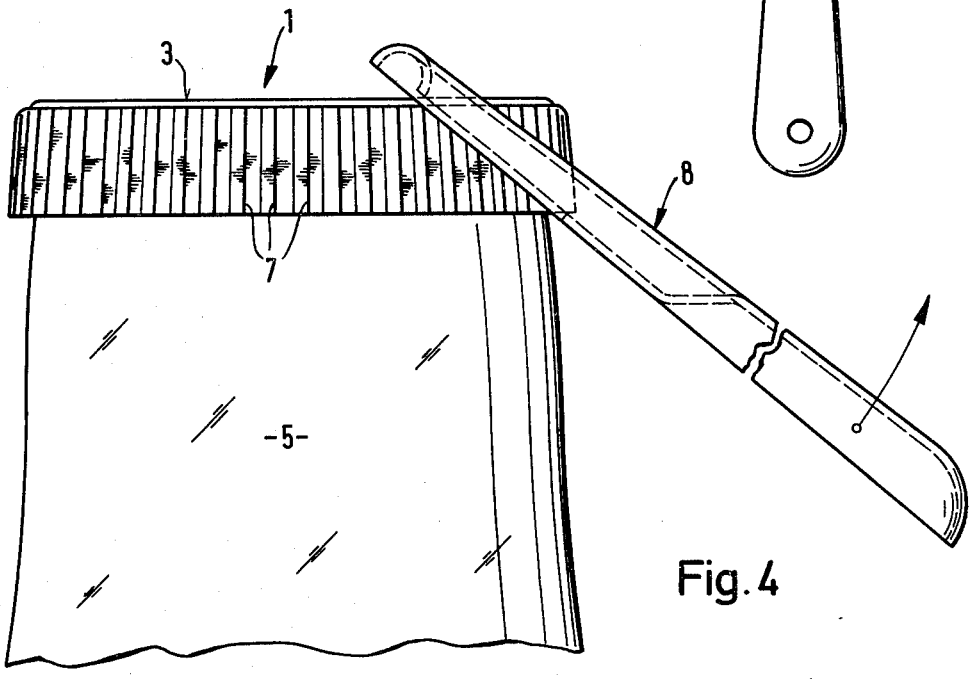
Fig. 4

STOPPER ARRANGEMENT FOR BOTTLES

FIELD OF THE INVENTION

This invention relates to stopper arrangements for bottles of the type having an externally threaded neck closable by a synthetic plastic screw cap, the screw cap having an internally threaded approximately cylindrical wall part which is closed by an upper lid surface. More particularly, the invention relates to an improved synthetic plastic screw cap which is removable conventionally by unscrewing, or by a conventional opener of the type used to remove crown cork caps or stoppers.

BACKGROUND AND SUMMARY OF THE INVENTION

Many stopper arrangements for bottles are known and used. Synthetic plastic stoppers are becoming more and more established now and in recent times, being usually cheaper to produce, simpler to use, and reliably reclosable. Both screw stoppers and snap stoppers have become established, usually replacing the former metal crown cork stoppers. Exemplary of such new stoppers are those disclosed and claimed in commonly assigned U.S. Pat. Nos. 3,866,784 and 3,987,921.

In practice problems often arise with the so-called crown cork stoppers. These problems concern especially the re-closure of the bottles with the stoppers, the stoppers being frequently set obliquely on the bottle neck by the user such that they tilt when pressed. It also occurs that the user does not apply sufficient physical force to bring the snap stopper to snap firmly onto the bottle again by vertical pressure.

These problems per se can be avoided by the use of screw stoppers. Nevertheless, it is also desirable to improve the known screw stoppers. For instance, the screw-on torque in some screw stoppers applied by poorly adjusted closure machines can become so high that in individual cases it is extremely difficult or practically impossible to unscrew the stopper from the bottle by hand. Moreover, different consumers of bottled beverages have different requirements for bottle stoppers. Thus, while in the private field simple opening and secure re-closure would appear to be the predominant requirements, for commercial users rapid opening of the bottle is frequently felt to be the most important criterion. Moreover, of course, re-closability is desired. This signifies that the trend of the private user is more in the direction of the screw stopper, while the commercial user (e.g restaurants) places the advantages of the crown cork stopper in the foreground, but at the same time considers the re-closability of the screw stopper per se as very desirable.

To applicant's knowledge, there are no known stoppers capable of fulfilling the requirement profile mentioned above. Perhaps the attempt to close a screw-threaded bottle with a crown cork stopper of the conventional kind comes nearest to meeting the requirement profile. However, in the application of the stopper, and especially also in opening with the bottle opener, the threading is in this case damaged, re-closability is not practically possible, there is increased danger of injury by the stopper, and furthermore considerable sealing problems occur with this stopper arrangement.

The instant invention is directed to the problem of avoiding the disadvantages of the prior art, that is, the problem of producing a new stopper arrangement and a screw cap for such a stopper arrangement which can be applied simply in the filling operation, seal reliably, be satisfactorily re-closable by hand, and furthermore can be opened either manually by unscrewing or with a conventional crown cork opener.

Generally in accordance with the invention, there is provided a screw cap comprising a generally cylindrical internally threaded wall part which is closed by an upper lid surface. The wall part has at least a section which protrudes outwardly from the bottle neck or from the main surface of the wall part so as to be engageable by the lifting portion of a crown cork opener. The formation of the thread, the distance between the lid surface and the protruding section, and the configuration and elasticity of the generally cylindrical wall part are such that the cap can be engaged and removed vertically from the bottle by a crown cork opener, without screwing movement, such that the cap can be removed by unscrewing or by a crown cork opener. Preferably the removal of the cap by a crown cork opener can be accomplished without damage to the wall part such as would preclude remounting of the cap to reseal the bottle.

Preferably the internal threading of the screw cap has at least two thread turn segments which rise at an angle less than 30°, and for use with most conventional crown cork openers the distance of the protruding section from the upper lid surface of the screw cap preferably is not greater than 14 mm.

Due to the arrangement of several thread turn segments and the relatively shallow angle of the thread rise or pitch, a relatively shallow height of the screw cap is rendered possible, thus making possible the application of a crown cork opener or other bottle opener of the type which lifts the cap from the bottle. At the same time, the elastic character and formation of the wall part guarantees that the screw stopper can be lifted over the thread turns of the bottle and opened without any rotating movement, similarly to a conventional crown cork cap or stopper.

As may be seen, such a stopper can either be screwed on and off by hand, or opened rapidly and simply with a bottle opener of conventional type. If, therefore, rapid opening is desired, or if the opening torque of the screw stopper is too great, the operator can make use of a bottle opener. The closing of the stopper on the other hand is possible simply by screwing on, while the use of the multiple threading shortens the screw-on time. Tilting of the stopper, as in crown cork stoppers, is no longer a problem, and re-closability is assured.

The invention can be realized especially advantageously if the threading consists of at least four thread turn segments and if the end of each thread turn segment overlaps the beginning of the next succeeding thread turn segment by less than 45°, and preferably less than 30°. In this way, on the one hand, low height or depth of the stopper and thus simple engageability with the bottle opener are ensured, and on the other hand rapid closure by, for instance, a quarter rotation of the stopper is achieved.

Especially good results are achievable in practice if the thread turn segments rise at an angle which is less than 15°, and preferably amounts to 6° to 7°. Thus, on the one hand secure self-holding of the screw cap on the bottle neck is guaranteed, and on the other hand opening is especially simplified since the thread turn segments with the slight inclination have practically the effect of the edge bead of a conventional bottle, and on application of vertical forces to the closure cap no tilting of the stopper, as in the direction of a steeply proceeding thread turn, occurs.

For the application of the bottle opener or crown cork opener, either a special protruding bead can be provided on the outer wall of the cap, or the entire edge of the screw cap can be made protruding and/or provided with ribs.

Good results are achievable if the thread profile height of the thread turn segments is less than 1 mm, and preferably amounts to about 0.6 to 0.8 mm. This on the one hand guarantees firm seating of the screw cap on the bottle neck, and on the other hand reliably renders possible the lifting of the screw cap with the bottle opener over the thread turn segments, without the wall of the screw cap being damaged, if the cap is stretched radially.

Good elasticity of the screw cap can be assured if the wall thickness of the cylindrical part in the threading region is less than 1.5 mm, and particularly if it amounts to about 1.0 mm. It has proved valuable that the wall part becomes thicker toward the lower edge, in order to guarantee firm seating on the bottle neck and good engageability of the bottle opener, but the wall thickness preferably decreases upwardly in order to improve the elasticity.

Low-pressure polyethylene and polypropylene have proved especially valuable as suitable plastic materials.

The re-closability of the screw cap in accordance with the invention can be assured especially advantageously if an inner seal part is provided which rests against the inside of the bottle neck and seals the latter, the seal section being situated at least 1 mm away from the lid top. With such a seal part, even in the case of incomplete screwing-on of the screw cap, the bottle is tightly closed on re-closure. This is of special importance in the case of pressurized or carbonated beverages.

As may be seen from the foregoing, the invention in a simple manner produces a new stopper arrangement and a screw cap for such a stopper arrangement which fulfills a plurlity of requirements, and is advantageous for various user circles and for the bottler, and which can be closed with high torque.

The invention is explained in greater detail hereinafter with reference to preferred embodiments illustrated in the appended drawings.

BRIEF DESCRIPTION OF THE DRAWINGS

FIG. 3 is a partially sectioned elevation of a screw cap according to FIGS. 1 and 2.

FIG. 4 illustates a stopper arrangement comprising a bottle neck and a stopper cap according to FIGS. 1 and 2, with a crown cork opener shown applied to the cap.

FIG. 5 diagrammatically shows a conventional crown cork opener of the type shown in FIG. 4, it being understood that such openers may take various other forms, and that other forms of bottle opener are equally useable with the invention.

DESCRIPTION OF PREFERRED EMBODIMENTS

Figure 1:
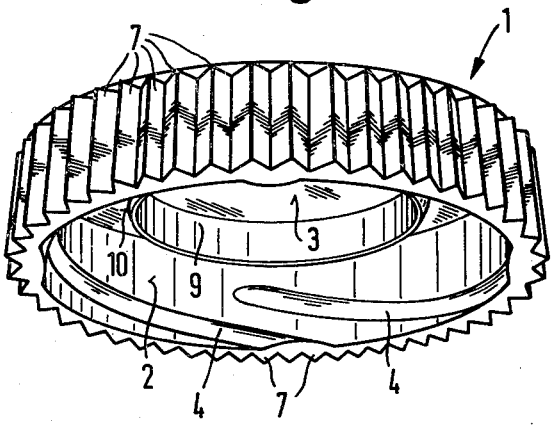
FIGS. 1 and 2 are perspective representations of a screw cap in accordance with a preferred embodiment of the invention.
Figure 2:
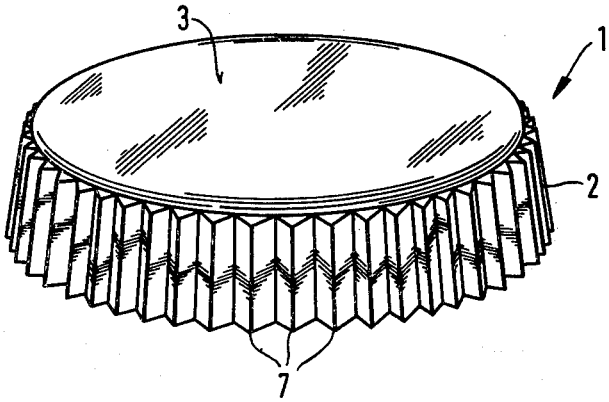

Referring to FIGS. 1 through 3, a synethetic plastics screw cap 1 has an approximately or generally cylindrical wall part 2 which is closed by a lid surface 3. The screw cap 1 is provided with internal threading consisting of four thread turn segments 4 which, by reason of the perspective illustration in FIG. 1, are only partially visible. The pitch of the thread turns is shown with exaggerated steepness in the drawings. In practice, the angle $\alpha$ (FIG. 3) in the cap thread as illustrated amounts to about 7°, since this assures optimum self-locking of the screw cap on the complementary threading of the bottle neck 5.

As shown, the thread turn segments 4 overlap only slightly, so that the height of the cap 1 can be kept low.

As shown in FIGS. 3 and 4, the ribs 7 provided on the wall part 2 thicken downwardly in such a way that a crown cork opener or bottle opener 8 readily engages beneath the lower edge of the cap 1. The ribs advantageously guarantee that the cylindrical wall part 2 is manually graspable and easily screwable by hand. On the other hand, the ribs provide adequate thickness of the stopper cap at the lower edge for the engagement of the crown cork opener 8, in conjunction with a reduction of the wall thickness d between the ribs 7 so as to ensure adequate elasticity of the wall part 2 in opening with the bottle opener 8. In the exemplary embodiment, the thickness d is about 1 mm, while the height h (FIG. 3) is about 9 mm, in order to guarantee good application of the bottle opener 8. In special utilization cases, it would of course be possible to provide a special section on the cylindrical wall part 2 with which the bottle opener 8 is engageable for the opening of the stopper. These sections could also be provided above the lower edge of the cylindrical wall part 2, for example in the form of noses.

As can be seen from FIG. 3, the thread profile height g is less than the thickness d of the cylindrical wall part 2, so that when the stopper is lifted away vertically by the bottle opener 8 its diameter does not have to be stretched excessively before the counter-threading on the bottle neck 5 (not shown) liberates the screw cap 1. The thread profile height g in the exemplary embodiment amounts to 0.7 mm, which in collaboration with the thickness d of the cylindrical wall part 2 and the utilized low-pressure polyethylene has proved to be an optimum value.

As may be seen from FIG. 3, the screw cap 1 has an inner seal part 9 which seals off the bottle neck internally in known manner. The inner seal part 9 has proved specially advantageous in combination with the remaining features of the invention, because it is possible to shift the seal section 10 so far downwardly into the bottle neck that even in the case of incomplete tightening of the screw cap 1 a reliable seal is achieved. In the exemplary embodiment, the distance of the seal section from the crown of the cap is about 1.0 mm.

As a whole, the invention can, of course, be adapted to a particular utilization case, dependent upon the diameter of the bottle neck, the utilized material, the internal pressure prevailing in the bottles, etc., simply by appropriate selection of material and dimensioning of the important dimensions d, g and h, as well as the thread pitch, without departing from the scope of the invention. Thus, for example, in the case of beverages having a high carbon dioxide content it can be entirely desirable to enlarge the thread profile height in order to guarantee firm seating. In this case it is then to be ensured that by appropriate selection of material and dimensioning of the wall thickness, the requisite elasticity is achieved to guarantee lifting away of the screw cap 1 by means of a crown cork opener 8.

If guarantee devices are to be provided on the screw cap for indication of opening for the first time, this can readily be effected by fitting of guarantee strips as in, for example, German published specification No. 25 29 289 (Obrist), or by appropriately bridged-over notchings in the wall part, for example according to German published specification No. 17 82 059 (Grussen). In this case if appropriate it should be ensured that with regard to the re-closability, the notchings in the side wall do not reach into the upper zone of the thread turns.

Having thus described my invention in the manner required by the statutes, including preferred embodiments thereof, I claim:

1. Stopper arrangement for bottles, comprising a bottle having an externally threaded neck which is closed by a synthetic plastic screw cap, the screw cap having an approximately cylindrical internally threaded wall part which is closed by an upper lid surface, the external threading of the bottle neck and the internal threading of the screw cap having at least two thread turn segments which rise at an angle less than 30°, the screw cap having on its circumference at least a section protruding sufficiently outwardly from the bottle neck for the application of the lifting portion of a crown cork opener, the distance of the protruding section from the upper lid surface of the screw cap being not greater than the clear internal width of a crown cork opener, and the cylindrical wall part being of such elastic formation that the stopper cap can be vertically lifted and opened by a crown cork opener without screwing movement.

2. Stopper arrangement according to claim 1, wherein the threading comprises at least four thread turn segments, and in that the end of each thread turn segment overlaps the beginning of the next succeeding thread turn segment by less than 45°.

3. Stopper arrangement according to claim 2 wherein the end of each thread turn segment overlaps the beginning of the next succeeding thread turn segment by less than 30°.

4. Stopper arrangement according to claim 1 wherein the thread turn segments rise at an angle less than 15°.

5. Stopper arrangement according to claim 1 wherein said protruding section is the lower edge of the cylindrical wall part of the screw cap.

6. Stopper arrangement as claimed in claim 1 wherein said screw cap has sealing means sealing said bottle, and wherein the formation of the threads, the distance between the lid surface and said protruding section, and the configuration and elasticity of said approximately cylindrical wall part are so related that the cap can be engaged and removed from the bottle by a crown cork opener without screwing movement and without damage to said wall part such as would preclude remounting of said cap by screwing to reseal said bottle, whereby said cap can be removed by unscrewing or by a crown cork opener, and can be thereafter remounted to reseal said bottle.

7. A synthetic plastic screw cap for bottles having a threaded neck, comprising a generally cylindrical internally threaded wall part which is closed by an upper lid surface, said threaded wall part having at least three internal threading segments so adapted and dimensioned as to engage with corresponding external threading segments on a bottle neck, the pitch angle of said internal threading segments being less than 10°, said wall part having a section protruding outwardly sufficiently so as to be engageable by the lifting portion of a crown cork opener, said cap being so configured and dimensioned and consisting of such an elastic synthetic plastic material that it can be engaged and removed by a crown cork opener without screwing movement over the corresponding thread turns of a bottle with which it is threadedly engaged without destrucion of said wall part such as would preclude remounting of said cap by screwing to reseal a bottle.

8. A screw cap according to claim 7, wherein the thread profile height of the internal threading segments is less than 1.0 mm.

9. A screw cap according to claim 7, wherein the thread profile height of the internal threading is from 0.6 to 0.8 mm.

10. A screw cap according to claim 7, wherein the wall thickness of the cylindrical part in the threading zone is less than 1.5 mm.

11. A screw cap according to claim 10, wherein the wall thickness amounts to about 1.0 mm.

12. A screw cap according to claim 7, wherein the screw cap consists of low-pressure polyethylene.

13. A screw cap according to claim 7, wherein the screw cap consists of polypropylene.

14. A screw cap according to claim 7, wherein the screw cap comprises a cylindrical internal seal part, the external diameter of which is so designed and adapted to the internal diameter of a bottle neck as to seal the latter, and in that the inner seal part has a seal section which is arranged at a distance of at least 1.0 mm from the inside of said upper lid surface.

15. A screw cap as claimed in claim 7, wherein the thread pitch angle is from about 6° to about 7°.

16. A screw cap according to claim 7 wherein the cylindrical wall part is ribbed on the outside to increase the grip quality, and in that the ribs and/or the wall part itself are thicker at the lower edge of the cap than at the upper edge in such a way that the lower edge section thus formed serves for the application of the lifting portion of a crown cork opener.

17. A screw cap as claimed in claim 7 wherein the height of the screw cap is not more than 14 mm.

18. A screw cap as claimed in claim 17 wherein the height of the screw cap is about 9 mm.

* * * * *